US005518359A

United States Patent [19]

Pratt

[11] Patent Number: 5,518,359

[45] Date of Patent: May 21, 1996

[54] MATERIAL HANDLING ATTACHMENT FOR FRONT-END LOADERS AND THE LIKE

[75] Inventor: Samuel S. Pratt, Bedford, Pa.

[73] Assignee: Rockland, Bedford, Pa.

[21] Appl. No.: 918,677

[22] Filed: Jul. 22, 1992

[51] Int. Cl.[6] ..... B66C 1/22

[52] U.S. Cl. ..... 414/724; 414/729; 414/622; 414/664; 37/406

[58] Field of Search ..... 414/724, 729, 414/618, 622, 662, 663, 664; 294/67.2, 67.22; 37/406

[56] References Cited

U.S. PATENT DOCUMENTS 2,684,165 7/1954 Hill ..... 414/622
3,409,157 11/1968 Lull ..... 294/67.22 X
3,669,293 6/1972 Bryan et al. ..... 294/67.22 X
3,817,567 6/1974 Lull ..... 294/67.22 X
4,402,645 9/1983 Broderick et al. ..... 414/664 X

*Primary Examiner*—Donald W. Underwood
*Attorney, Agent, or Firm*—Lalos & Keegan

[57] ABSTRACT

A material handling attachment mountable on a pair of lifting arms of a vehicle comprising a mounting frame mountable on the lift arms of the vehicle and having at least one guide disposed thereon, a tine having a support arm portion cooperating with and displaceable along the guide. The mounting frame and the support arm portion of the tine are operatively interconnected for displacing the tine relative to the mounting frame.

21 Claims, 2 Drawing Sheets

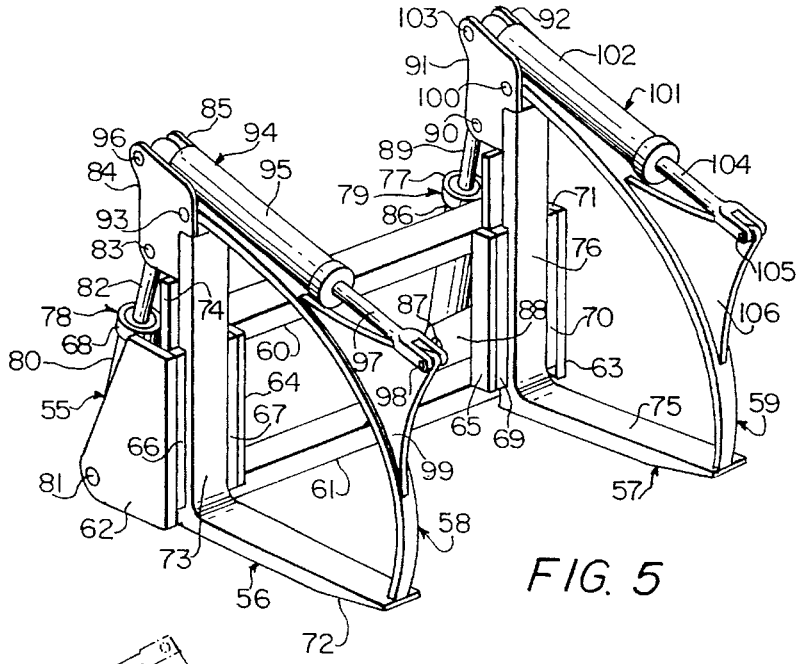
FIG. 5
FIG. 6
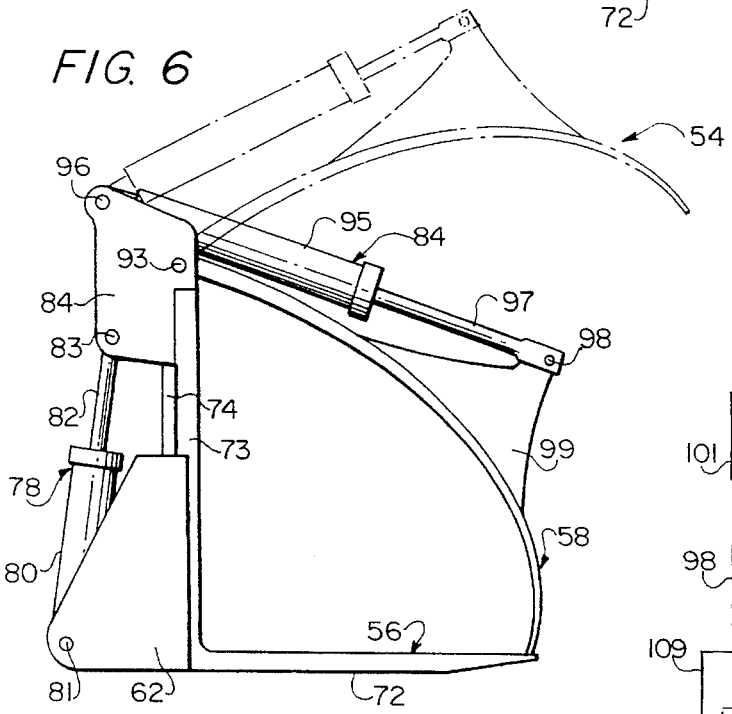
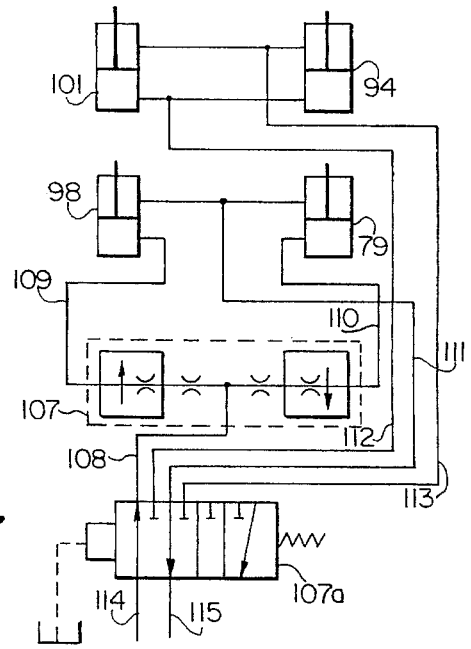
FIG. 7

MATERIAL HANDLING ATTACHMENT FOR FRONT-END LOADERS AND THE LIKE

BACKGROUND OF THE INVENTION

This invention relates to a material handling attachment adapted to be mounted on a pair of lift arms of a vehicle such as a front-end loader, and more particularly to such an attachment which is capable of displacing a load of material within a greater range of travel than comparable prior art attachments.

In the prior art, there has been developed a forklift type of attachment adapted to be mounted on the lifting arms of a vehicle such as a conventional front-end loader. Typically, such attachment has consisted of a mounting frame pivotally mountable on the lift arms of a front-end loader and connectable to a pair of tilt cylinders of the front-end loader for tilting the mounting frame, and a pair of tines rigidly mounted on the mounting frame which are adapted to be inserted in clearances beneath a load to be lifted for lifting and relocating such loads. In the use of such an attachment, the front-end loader first is positioned before the load to be repositioned with the tines thereof disposed usually at ground level and in alignment of the clearances beneath the load, the machine is advanced to position the tines beneath the load, the lift arm cylinders are operated to lift the load on the tines, the machine is maneuvered to the desired location of the load, and the described procedure essentially is reversed to reposition the load at the desired location.

More recently, for the purpose of expanding the capability of such attachments, the tines thereof have been made vertically displaceable relative to the mounting frame. Typically, such attachments have consisted of a mounting frame pivotally mountable on a set of lift arms, a tine support frame mountable on the mounting frame and displaceable vertically relative to the mounting frame and a set of tines rigidly mounted on the vertically displaceable support frame. Examples of such attachments are disclosed in U.S. Pat. Nos. 3,070,244 to LeGrand H. Lull, 3,647,099 to Russell F. Carriere, 3,966,070 to John W. Barth and 4,657,471 to Akebumi Shinoda.

Although such improved forklift type attachments have been an improvement over prior art attachments in providing a greater range of travel of the tines, they have been found to be deficient in several respects. In particular, it has been found that the mounting and/or displaceable support frames of such attachments continue to obstruct the line of sight of the operator viewing the ends of the tines in attempting to align the tines with the clearances beneath a load to be lifted and to position the tines therein. In addition, the use of large and bulky displaceable, tine support frames has been found not only to reduce the payload of such attachments but to substantially increase manufacturing costs. It thus has been found to be desirable to provide an attachment of the type described having an extended range of travel of the tines thereof which eliminates such deficiencies. It has also been found to be desirable to provide an attachment having tines which can be actuated independently of each other.

Accordingly, it is the principal object of the present invention to provide an improved material handling attachment mountable on a pair of lift arms of a vehicle such as a front-end loader.

Another object of the present invention is to provide an improved material handling attachment mountable on a set of lift arms of a vehicle of the type having a set of tines insertable in clearances beneath a load to be lifted.

A further object of the present invention is to provide an improved forklift type attachment mountable on a set of lift arms of a front-end loader and the like, in which the tines of the attachment are displaceable vertically relative to a frame on which they are supported.

Another object of the present invention is to provide an improved forklift type of attachment mountable on a set of lift arms on a front-end loader and the like, in which the tines of the attachment are displaceable independent of each other.

A still further object of the present invention is to provide an improved forklift type attachment mountable on a set of lift arms of a front-end loader and the like, in which the line of sight of the operator with the free ends of the tines of the attachment is less obscured compared to comparable prior art attachments.

Another object of the present invention is to provide an improved forklift type attachment mountable on a set of lift arms of a front-end loader or the like, having a set of tines displaceable vertically relative to a mounting frame thereof, and providing a lesser weight than comparable prior art attachments, thus providing an increased payload of the attachment.

Another object of the present invention is to provide an improved forklift type attachment mountable on a set of lift arms of a front-end loader or the like, having a set of load supporting tines displaceable vertically relative to a support frame thereof, in which the manufacturing costs thereof are substantially reduced.

A still further object of the present invention is to provide an improved forklift type attachment mountable on a set of lift arms of a front-end loader and the like, and having a set of load supporting tines displaceable vertically relative to a support frame thereof, which is comparatively simple in design, comparatively inexpensive to manufacture and easy to maintain and service.

Other objects and advantages of the present invention will become more apparent to those persons having ordinary skill in the art to which the present invention pertains from the following description taken in conjunction with the accompanying drawings.

BRIEF DESCRIPTION OF THE DRAWINGS

FIG. 5 is a perspective view of another embodiment of the present invention;

FIG. 6 is a side elevational view of the embodiment shown in FIG. 5, illustrating the clamp mechanism of the attachment in the closed, clamping position in solid lines, and in the open, unclamped position in phantom lines; and FIG. 7 is a schematic of the hydraulic control system for the embodiment shown in FIGS. 5 and 6.

DESCRIPTION OF THE PREFERRED EMBODIMENTS

Figure 1:
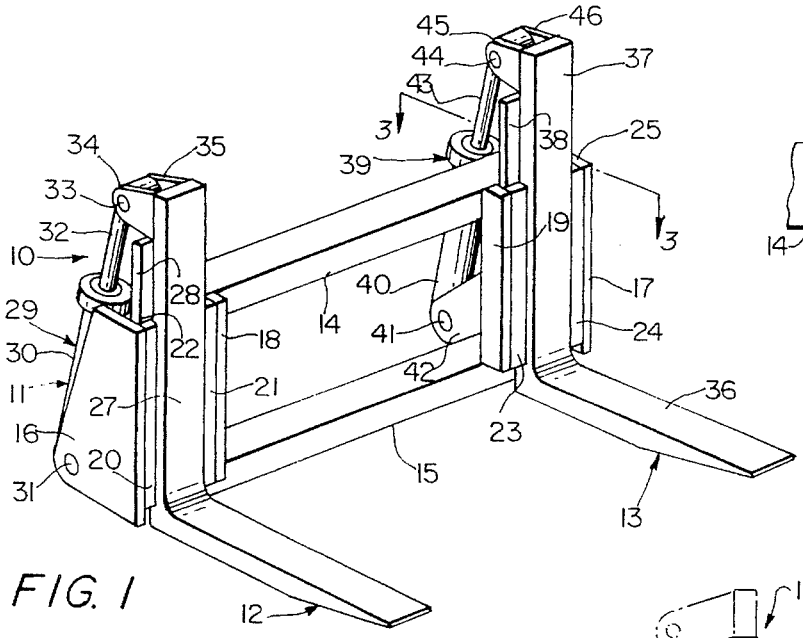
FIG. 1 is a perspective view of an embodiment of the present invention.
Figure 3:
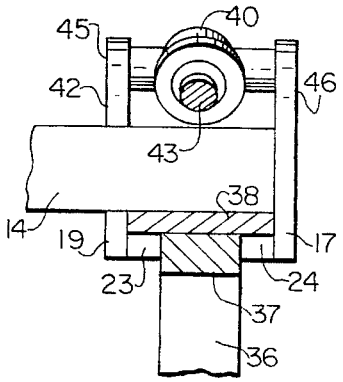
FIG. 3 is an enlarged cross-sectional view taken along line 3—3 in FIG. 1.
Figure 2:
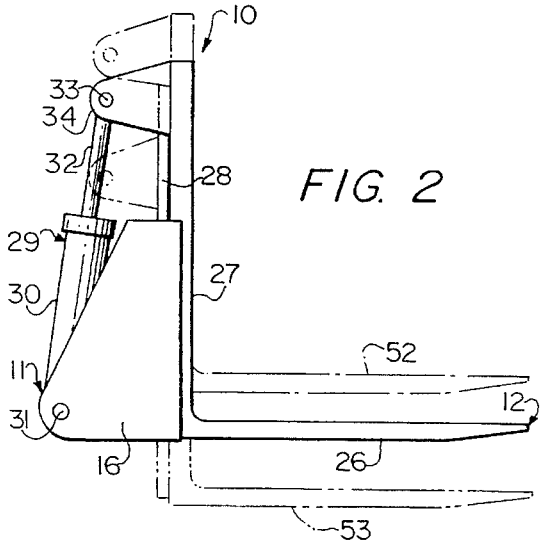
FIG. 2 is a side elevational view of the embodiment shown in FIG. 1, illustrating certain positions of the tines in phantom lines.

Referring to FIGS. 1 through 3, there is shown an attachment 10 embodying the present invention which generally includes a mounting frame 11 adapted to be pivotally connected to a set of lift arms 5 of a front-end loader or the like via a pivotally connecting means 6, and a set of tines 12 and 13 mounted on the mounting frame and displaceable substantially vertically relative thereto. The lift arms 5 and connecting means 6 as shown in FIG. 1 are for illustration only; any suitable lift arms and connecting means will suffice. The mounting frame includes a pair of transversely disposed, vertically spaced beams 14 and 15, having a set of end brackets 16 and 17 secured to the ends thereof, preferably by welding. Spaced inwardly of brackets 16 and 17 is a set of plates 18 and 19, also preferably secured to beams 14 and 15 by welding. Bracket 16 and plate 18 further are provided with a set of strip members 20 and 21 rigidly secured thereto by welding to provide a vertical guide channel or slot 22 at one end of the mounting frame, having a T-shaped cross-sectional configuration. Similarly, end bracket 17 and plate 19 are provided with a set strip member 23 and 24 rigidly secured thereto, preferably by welding, to provide a vertically disposed guide channel or slot 25 disposed parallel to guide channel 22 and also having a T-shaped cross-sectional configuration. The rear surfaces of such channels are formed by the front faces of beams 14 and 15, lying in the same vertical plane, and a set of back plate members disposed between and secured to the beam members and having front faces lying in the same vertical plane as the front faces of the beam members. However, it will be appreciated by those of ordinary skill in the art that the guide channel may be made in any suitable manner. For instance, T-shaped cross-sectional configuration may be replaced with any other suitable configuration, such as a U-shaped cross-sectional configuration. Additionally, structures other than the front faces of the beam members could be used to create the guide channel.

The two tine members are essentially identical in construction. Tine member 12 includes a forwardly extending tine portion 26 and a support arm portion 27 disposed at a right angle to tine portion 26. In the mounted condition, tine portion 26 projects forwardly at substantially a right angle relative to the mounting frame, and support arm portion 27 is disposed and displaceable vertically in the throat portion of guide channel 22, between strip members 20 and 21. Formed on the backside of support arm portion 27 and having a width greater than the support arm portion is a retainer plate member 28 received within and displaceable along the head portion of guide channel 22. With such a construction, it will be noted that tine member 12 may be displaced vertically relative to the mounting frame within guide channel 22 and would be precluded from being displaced longitudinally or transversely, or be angularly displaced about a horizontal or vertical axis.

Displacement of tine 12 relative to the mounting frame is provided by a hydraulic cylinder assembly 29 having a cylinder 30 provided with a bracket mounted on a pin 31 secured to end bracket 16 and a spaced bracket mounted on beams 14 and 15 in longitudinal alignment with bracket 18, and a rod 32 pivotally connected to a pin 33 mounted in a set of brackets 34 and 35 secured to the upper end of support arm portion 27 of tine member 12. It will be appreciated that by extending and retracting rod member 32 of cylinder assembly 29, tine member 12 will be caused to be displaced. vertically within guide channel 22 relative to mounting frame 11.

Tine member 13 similarly includes a forwardly projecting portion 36 and a support arm portion 37 disposed at right angles to tine portion 36 and received within the throat portion of guide channel 25, between strip members 23 and 24. Support arm portion 37 also is provided with a retainer plate 38 secured to the rearward side thereof and disposed and displaceable vertically within the head portion of guide channel 25. The vertical displacement of tine member 13 is provided by a hydraulic cylinder assembly 39 including a cylinder 40 having a bracket pivotally connected to a pin 41 mounted in end bracket 17 and a rearwardly extending bracket 42, and a rod 43 pivotally connected to a pin 44 mounted in a set of brackets 45 and 46 secured to the rear, upper end of support arm portion 37. Again, as with tine 12, it will be appreciated that by extending and retracting rod 43 of cylinder assembly 39, tine member 13 will be caused to be displaced vertically within guide channel 25, relative to the mounting frame.

Figure 4:
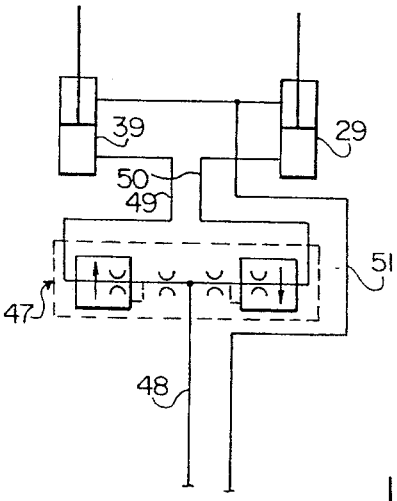
FIG. 4 is a schematic of the hydraulic control system for the embodiment shown in FIGS. 1 through 3.

FIG. 4 illustrates schematically the hydraulic control system for the attachment shown in FIGS. 1 through 3. Essentially, it consists of a directional control valve mounted on the front-end loader (not shown) and a flow divider 47, also mounted on frame 11 of the attachment 10, operatively connected to cylinder assemblies 29 and 39. The system includes a pressure line 48 interconnecting the directional control valve and the flow divider, a set of pressure lines 49 and 50 interconnecting the flow divider and the piston ends of the cylinders, and a fluid line 51 interconnecting the directional control valve and the rod ends of the cylinders.

It will be appreciated that by supplying fluid under pressure to either set of ends of the cylinders, the pistons will be caused to extend and retract in unison to displace tines 12 and 13 in unison along guide channels 22 and 25, relative to the mounting frame. Preferably, the components are dimensioned so that tine portions 26 and 36 may be caused to be displaced above the lower end of-the mounting frame as shown by phantom lines 52 in FIG. 2, and below the lower end of the mounting frame also as shown by phantom lines 53 in FIG. 2.

Figure 4A:
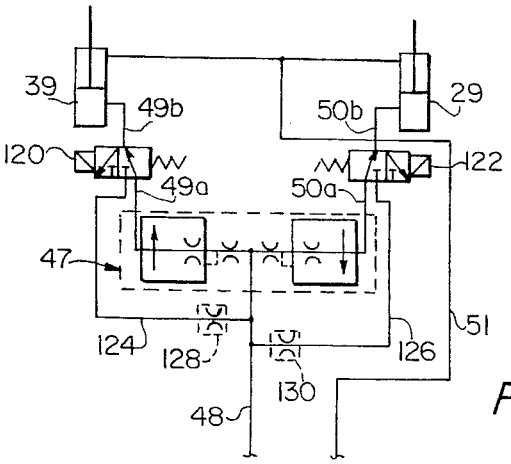
FIG. 4*a* is a schematic of the hydraulic control system for another embodiment of the present invention.

FIG. **4*a* illustrates schematically the hydraulic control system for the attachment shown in FIGS. 1 through 3. However, the hydraulic control system illustrated in FIG. 4*a* permits tine members 12 and 13 to be actuated independently of each other. As in FIG. 4, the system consists of a direction control valve mounted on the front-end loader (not shown) and a flow divider 47, such as Model PD PDC manufactured by Gresen of Sarasota, Florida. The flow divider is mounted on frame 11 of attachment 10 and is operatively connected to cylinder assemblies 29 and 39 by means of a set of normally open control valves 120 and 122. The system includes a pressure line 48 interconnecting the directional control valve and the flow divider 47 and a fluid line 51 interconnecting the directional control valve and the rod ends of the cylinders. A set of pressure lines 49*a* and 50*a* interconnect the flow divider and the control valves 120 and 122. A second set of pressure lines 49*b* and 50*b*** interconnect the control valves and the piston ends of the cylinders.

The system further includes a first branch line 124 and a second branch line 126. The branch line 124 and 126 extend from pressure line 48 to the control valves 120 and 122, respectively. Located on branch lines 124 and 126 is a set of flow restricters 128 and 130.

It will be appreciated that when it is desired that both tines operate simultaneously, fluid will be supplied uniformly to pistons 29 and 39 via the flow divider 47. However, when only one tine is to be operated, for instance, tine 12 operated by piston 29, control valve 122, will be energized, causing the control valve to switch to the off position, whereupon the flow of fluid from the flow divider along line **50*a* to the control valve 122 will be blocked. The flow divider reacts to this blockage by blocking flow to the other control valve 120. Fluid then travels via pressure line 126 through control valve 122 to piston 29. It will be appreciated that the restricter 130 restricts the flow of fluid through branch line 126**, so that optimum control of the operation of the tine is achieved.

FIGS. 5 and 6 illustrate an attachment 54 embodying the present invention which includes a mounting frame 55 mountable on the lift arms of a front-end loader or similar vehicle, a set of tine members 56 and 57 mounted on the mounting frame and displaceable vertically relative thereto and a set of clamping members 58 and 59 mounted on the tine members and displaceable angularly relative thereto to closed, clamping positions and open, unclamping positions. Mounting frame 55 is constructed substantially similarly to mounting frame 29 and includes a set of transversely disposed, vertically spaced beams 60 and 61 secured together by a set of end brackets 62 and 63. Spaced inwardly from end brackets 62 and 63 and secured to the front sides of beams 60 and 61 is a set of plate members 64 and 65. One end of the mounting frame is provided with a set of strips 66 and 67 rigidly secured to the inner sides of end bracket 62 and plate member 64 and cooperating with a back plate member mounted on beams 60 and 61 to provide a vertically disposed guide channel or slot 68 having a T-shaped cross-sectional configuration. Similarly, the other end of the mounting frame is provided with a set of strips 69 and 70 which cooperate with a back plate mounted on beams 60 and 61 to provide a vertically disposed guide channel or slot 71 also having a T-shaped cross-sectional configuration and being disposed parallel with guide channel 68.

Tine member 56 generally is similar in construction to tine member 12 and includes a forwardly projecting portion 72 and a support arm portion 73. The support arm portion is disposed at substantially a right angle to tine portion 72 and is received and displaced vertically within the throat portion of guide channel 68 between strip members 66 and 67. The support arm portion also includes a retainer plate 74 rigidly secured to the backside thereof and received and displaceable vertically within the head portion of guide channel 68 between bracket 62 and plate member 64. Similarly, tine member 57 includes a forwardly projecting portion 75 and a support arm portion 76 disposed at substantially a right angle to tine portion 75. Support arm portion 76 further is received and vertically displaceable within the throat portion of guide channel 71 between strip members 69 and 70, and is provided with a retainer plate 77 secured to the backside thereof which is received and vertically displaceable within the head portion of guide channel 71 between bracket 63 and plate member 65.

Tine members 56 and 57 are displaced vertically in guide channels 68 and 71 by means of a set of hydraulic cylinder assemblies 78 and 79. Cylinder assembly 78 includes a cylinder 80 having a bracket at its lower end pivotally connected to a pin 81 mounted in end bracket 62 and a transversely spaced bracket on beams 60 and 61 (not shown), and a rod 82 pivotally connected to a pin 83 mounted on a set of brackets 84 and 85 rigidly secured to the upper end of support arm portion 73. Cylinder assembly 79 similarly includes a cylinder 86 having a bracket at its lower end pivotally connected to a pin 87 mounted in end bracket 63 and a bracket 88 projecting rearwardly of plate member 65, and a rod 89 pivotally connected to a pin 90 mounted on a set of brackets 91 and 92 rigidly secured on the upper end of support arm portion 76 of tine member 57. It will be appreciated that upon extending and retracting the rod portions of cylinder assemblies 78 and 79, the tine members will be caused to be displaced vertically relative to the frame member within guide channels 68 and 71.

Clamp members 58 and 59 also are similar in construction and operation. Clamp member 58 has a curved or arcuate configuration, with its rear end pivotally connected to a pin 93 mounted on brackets 84 and 85 and its forward end engaging the forward end of tine portion 72 when the clamp member is in the fully closed or clamped position as shown in FIG. 5. The clamp member is displaced angularly relative to tine member 56 by means of a hydraulic cylinder assembly 94 having a cylinder 95 pivotally connected at a rear end thereof to a pin 96 rigidly mounted on brackets 84 and 85, and a rod 97 pivotally connected at its free end to a pin 98 mounted on a bracket 99 rigidly secured to the upper side of clamping member 58.

Clamp member 59 similarly has a curved or arcuate configuration, having the rear end thereof pivotally connected to a pin 100 mounted on brackets 91 and 92 and a front end portion engaging the forward end of tine 57 when the clamp member is in the fully closed or clamped position as shown in FIG. 5. Clamp member 59 is displaced angularly relative to tine member 57 by means of a hydraulic cylinder assembly 101 having a cylinder 102 pivotally connected at its rearward end to a pin 103 mounted on brackets 91 and 92, and a rod 104 pivotally connected at its free end to a pin 105 mounted on a bracket 106 secured to the upper side of clamp member 59.

FIG. 7 is a schematic of the control system for operating the attachment shown in FIGS. 5 and 6. The control system includes a directional valve (not shown) disposed on the front-end loader or other vehicle on which the attachment is mounted, a double selector valve 107*a* and a flow divider 107, also mounted on the vehicle, and a set of fluid lines interconnecting a source of fluid under pressure and the cylinder assemblies through the directional and selector valves and the flow divider. As shown in FIG. 7, a pressure line 108 interconnects selector valve 107*a* and flow divider 107, and a pair of pressure lines 109 and 110 interconnect the flow divider and the piston ends of the cylinders of cylinder assemblies 78 and 79. The rod ends of the cylinders of assembly 78 and 79 are connected to the selector valve by means of fluid line 111. Selector valve 107*a* also is connected to the piston ends of the cylinders of assemblies 94 and 101 by a fluid line 112, and is connected to the rod ends of the cylinders of assemblies 94 and 101 by fluid line 113. The directional valve is connected to the selector valve by means of fluid lines 114 and 115.

In the operation of the attachment shown in FIGS. 5 and 6, the directional and selector valves are operated to retract cylinder assemblies 78, 79, 94 and 101 to position the attachment as shown in FIG. 6 with the tine members in their lower positions and the clamp members in their open or unclamped positions (as shown in phantom lines). It should be noted that cylinders 80 and 86 can be further retracted so that tine assemblies 57 and 72 can be positioned much lower than is shown in FIG. 6. The controls are then operated on the vehicle to position the tine members beneath a load to be transported. In thus positioning the tine members, the directional and selector valves may be operated to adjust the height of the tine members relative to the mounting frame. Once the tine members are properly positioned beneath the load, the valves are operated to engage the underside of the load and lift it slightly, and the valves are further operated to extend the rods of cylinder assemblies 94 and 101 to clamp the load between the tine and clamp members. With the load thus supported on the tines and clamped by the clamp members, further controls on the vehicle are operated to transport the load to the desired location. Upon arrival at the desired location, the procedure as described essentially is reversed to deposit the load at the desired location.

If the load is to be placed at an elevated position, the operator merely can operate the controls on the vehicle to raise the lift arms of the vehicle. If further height adjustment is required, the selector valve may be operated to displace the tine members supporting the load vertically either up or down. Maximum height can be achieved by moving the lift arms of the vehicle to their maximum height and extending cylinder assemblies 78 and 79 to displace the tine members to their uppermost positions relative to the mounting frame. Under such circumstances, the operator has maximum flexibility to position the load within a wide range of heights.

Preferably, in either embodiment as described, the mounting frame will be provided with another set of brackets 116 so that the mounting frame may be connected to a set of tilt cylinder 117 on the vehicle. By coordinating the operation of the lift cylinders and tilt cylinders of the vehicle, the projecting portions of the tines will remain level which could be required in some operations. In addition, the tilt cylinders may be used to tilt the entire attachment in circumstances where such orientation of the attachment is desired.

By the elimination of an entire frame on which the tine members are rigidly secured and providing for the displacement of such a support frame on a mounting frame supported on the lift arms of the vehicle, as in the prior art, the present invention not only provides the advantage of providing an unobstructive line of sight of the operator with the tips of the tine members but further provides for decreased manufacturing cost and increased payload of the attachment.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. A material handling attachment mountable on a pair of lift arms of a vehicle comprising:

a mounting frame mountable on said lift arms and having at least one guide means disposed thereon, said mounting frame including means for pivotally connecting said mounting frame to said lift arms;

a tine having a support arm portion cooperating with and displaceable along said guide means;

means operatively interconnecting said mounting frame and said support arm portion for displacing said tine along said guide means relative to said mounting frame; and including a clamp member pivotally connected to said support arm portion of said tine, and means operatively interconnecting said support arm portion and said clamp member for angularly displacing said clamp member relative to said tine for clamping material disposed between said tine and said clamp member.

2. An attachment according to claim 1 wherein said clamp member has a curved configuration.

3. An attachment according to claim 1 wherein said means for pivotally displacing said clamp member relative to said tine comprises a hydraulically actuated cylinder assembly.

4. A material handling attachment mountable on a pair of lift arms of a vehicle comprising:

a mounting frame mountable on said lift arms, said mounting frame including a pair of vertically spaced, transversely disposed members and a pair of members interconnecting end portions of said transversely disposed members providing an opening therein permitting a vehicle operator to have a clear line of sight through said mounting frame, said mounting frame including means for pivotally connecting said mounting frame to said lift arms;

said interconnecting means having means defining a pair of transversely spaced, vertically disposed guide means;

a pair of tines, each of said tines including a support arm portion received within and displaceable along one of said guide means, and a forwardly projecting portion; and each of said tines having means operatively interconnecting said mounting frame and said tine for displacing said tine relative to said mounting frame along said guide means.

5. An attachment according to claim 4 wherein said mounting frame includes means connectable to a tilting means mounted on said vehicle.

6. An attachment according to claim 4 wherein said means for displacing said tine relative to said mounting frame comprises a hydraulically actuated cylinder assembly interconnecting said mounting frame and said support arm portion of said tine.

7. An attachment according to claim 4 wherein said guide means comprises a channel and said support arm portion is displaceable along said channel.

8. An attachment according to claim 7 wherein said channel has a T-shaped cross-sectional configuration and said support arm portion has a cooperable T-shaped cross-sectional configuration to permit said support arm portion to be freely displaced along the length of said channel and to prevent lateral displacement thereof.

9. An attachment according to claim 4 wherein said support arm portion is disposed at a right angle to said projecting tine portion.

10. An attachment according to claim 4 including a clamp pivotally connected to said support arm portion, and means operatively interconnecting said support arm portion and said clamp for angularly displacing said clamp relative to said tine for clamping material disposed between said tine and said clamp.

11. An attachment according to claim 10 wherein said clamp has a curved configuration.

12. An attachment according to claim 10 wherein said means for angularly displacing said clamp relative to said tine comprises a hydraulically actuated cylinder assembly.

13. An attachment according to claim 4 wherein said displacing means operatively interconnecting said mounting frame and said support arm portion is operable to extend said projecting tine portion below a lower end of said mounting frame.

14. A material handling attachment on a pair of lift arms of a vehicle comprising:

a mounting frame mountable on said lift arms and having a pair of guide means disposed thereon, said mounting frame including means for pivotally connecting said mounting frame to said lift arms;

a pair of tines, each of said tines including a support arm portion cooperating with and displaceable along one of said guide means;

each of said tines having means operatively interconnecting said mounting frame and said support arm for displacing said tine along said guide means relative to said mounting frame;

each of said tines having means for individually controlling said displacing means cooperatively with said other tine; and each of said tines having means for individually controlling said displacing means such that each of said tines is movable relative to said mounting frame independently of said other tine.

15. An attachment according to claim 14 wherein said mounting frame includes means connectable to tilting means mounted on said vehicle.

16. An attachment according to claim 14 wherein said means for displacing said tine relative to said mounting frame comprises a hydraulically actuated cylinder assembly interconnecting said mounting frame and said support arm portion of said tine.

17. An attachment according to claim 14, wherein said guide means comprises a channel and said support arm portion of said tine is displaceable along said channel.

18. An attachment according to claim 17, wherein said channel has a T-shaped cross-sectional configuration and said support arm portion has a cooperable T-shaped cross-sectional configuration to permit said support arm to be freely displaceable along the length of said channel and to prevent lateral displacement thereof.

19. An attachment according to claim 14, wherein said support arm portion is disposed at a right angle relative to a forwardly projecting portion of said tine.

20. A material handling attachment mountable on a pair of lift arms of a vehicle comprising:

a mounting frame mountable on said lift arms and having at least one guide means disposed thereon, said mounting frame including means for pivotally connecting said mounting frame to said lift arms;

a tine having a support arm portion cooperating with and displaceable along said guide means;

means operatively interconnecting said mounting frame and said support arm portion for displacing said tine along said guide means relative to said mounting frame;

wherein said guide means comprises a channel and said support arm portion of said tine is displaceable along said channel; and wherein said channel and said support arm portion have cross-sectional configurations cooperable to one another to permit said support arm to be freely displaceable along the length of said channel and to prevent lateral displacement thereof.

21. A material handling attachment mountable on a pair of lift arms of a vehicle comprising:

a mounting frame mountable on said lift arms and having at least one guide means disposed thereon, said mounting frame including means for pivotally connecting said mounting frame to said lift arms;

a tine having a support arm portion cooperating with and displaceable along said guide means;

means operatively interconnecting said mounting frame and said support arm portion for displacing said tine along said guide means relative to said mounting frame;

wherein said guide means comprises a channel and said support arm portion of said tine is displaceable along said channel; and wherein said channel has a T-shaped cross-sectional configuration and said support arm portion has a cooperable T-shaped cross-sectional configuration to permit said support arm portion to be freely displaceable along the length of said channel and to prevent lateral displacement thereof.

* * * * *